US010167648B1

(12) United States Patent
Nelson

(10) Patent No.: US 10,167,648 B1
(45) Date of Patent: Jan. 1, 2019

(54) POOL SKIMMER

(71) Applicant: Garrison B. Nelson, League City, TX (US)

(72) Inventor: Garrison B. Nelson, League City, TX (US)

( * ) Notice: Subject to any disclaimer, the term of this patent is extended or adjusted under 35 U.S.C. 154(b) by 0 days.

(21) Appl. No.: 15/588,429

(22) Filed: May 5, 2017

Related U.S. Application Data

(60) Provisional application No. 62/449,107, filed on Jan. 22, 2017.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.2, 167.1, 167.19, 242.1, 416.1, 210/416.2
See application file for complete search history.

(56) References Cited

U.S. PATENT DOCUMENTS 4,068,327 A 1/1978 Heinlein
5,085,767 A 2/1992 Beers
5,833,845 A * 11/1998 Anderson ..... E04H 4/065 210/167.19
5,919,359 A * 7/1999 Bisseker ..... B01D 29/117 210/167.19
6,274,047 B1 * 8/2001 Bates ..... B01D 29/27 15/1.7
6,869,530 B1 * 3/2005 Venezia ..... A01K 63/045 119/263
7,029,577 B2 * 4/2006 Cummins ..... A01K 63/04 210/167.31
7,455,767 B2 11/2008 Pamperin
7,727,387 B2 6/2010 Goggin
2006/0021922 A1 * 2/2006 Lamberts Van Assche ..... B01D 24/14 210/167.13
2011/0247970 A1 * 10/2011 Evingham ..... B01D 29/21 210/85
2013/0334113 A1 * 12/2013 Erlich ..... E04H 4/1209 210/167.1
2015/0247330 A1 9/2015 Norberto, III
2015/0247331 A1 9/2015 Norberto, III et al.
2015/0247332 A1 9/2015 Norberto, III et al.

* cited by examiner

*Primary Examiner* — Fred Prince
(74) *Attorney, Agent, or Firm* — Kenneth A. Roddy

(57) ABSTRACT

A pool skimmer apparatus has a weir in an inlet at an upper end of a main housing, at least one submersible DC powered pump in a bottom portion thereof, a removable debris-collection net disposed between the weir and the at least one pump wherein water and floating debris are drawn over the inlet weir, into the net where the floating debris is captured, and the filtered water is discharged through a discharge nozzle that can be manually rotated by a user to selectively adjust the angular direction of the water discharged by the pump to create a desired circulating current pattern within the pool that will effectively circulate more of the pool water and any floating debris therein toward the inlet of the skimmer.

7 Claims, 5 Drawing Sheets

POOL SKIMMER

CROSS REFERENCE TO RELATED APPLICATION

This application claims priority of U.S. provisional patent application Ser. No. 62/449,107, filed on Jan. 22, 2017.

BACKGROUND OF THE INVENTION

1. Field of the Invention

This invention relates generally to automated devices used to clean pools of surface debris and, more particularly, to an automated pool skimmer apparatus having a weir in an inlet at an upper end of a main housing, at least one submersible pump in a bottom portion thereof, and a removable filter screen disposed between the weir and the at least one pump wherein water and floating debris are drawn over the inlet weir, into the filter where the floating debris is captured, and the filtered water is discharged through an adjustable direction nozzle to create a current within the pool that will circulate more of the pool water into the housing.

2. Background Art

A conventional method for removing the surface debris is to manually remove the debris with a net; however, this can be a very laborious and time consuming process. Another conventional method of removing surface debris of debris is accomplished by skimmers, integral debris-collection net s, and automated pool cleaners, however, most of these devices lack the capability or power to adequately circulate water throughout a pool. Adequate water circulation is very important because the more debris circulates throughout a pool that is being cleaned, the more likely it is that the debris will come in contact with the filtering or cleaning device. Furthermore, if a pool cleaning device has a small debris-collection net, then it will need to be cleaned frequently in order to maintain the efficiency and cleaning ability of the device. Therefore, there is a need in the art for an automated pool cleaning device that is adapted to create adequate water circulation throughout a pool in order to maximize the efficiency of the pool cleaning device.

There are several patents directed toward pool skimmer devices of various construction. The following are several examples.

Heinlein, U.S. Pat. No. 4,068,327, discloses a swimming pool surface debris skimmer and method wherein surface debris on a swimming pool is floated toward and into a skimmer pocket and directed toward an overflow. A skimmer bar projecting generally obliquely toward the direction from which normal circulation of water in the pool takes place defines, with the adjacent pool side, the pocket for receiving and directing the debris. The skimmer bar has a bracket for mounting the bar removably to project from the side of the pool adjacent to the overflow outlet.

Beers, U.S. Pat. No. 5,085,767, discloses a swimming pool skimming apparatus for removal of surface debris from the water surface of swimming pools, which includes a buoyant tube arrayed along its entire length with a fibrous absorbent material affixed at each of the extreme ends of the tube. The entire central portion of the material between the extreme ends is permitted to hang loose and unfettered. The skimming apparatus is swept along the pool and then wound one end inside the other until the inner circle has been reduced to a diameter of two or three feet thereby concentrating the density of the debris which then can be easily removed.

Pamperin, U.S. Pat. No. 7,455,767, discloses a device for gathering debris floating at or near the surface of a swimming pool. The device has a spray head assembly releasably installable in front of an in-wall skimmer on a side of the swimming pool, the spray head assembly comprising a connector through which a pressurized flow of water is receivable from an external source. An inlet duct assembly is pivotably connected to the spray head assembly, and an elongate debris collection bag is releasably attachable to the inlet duct assembly. The collection bag extends into the pool at or near the water surface and substantially perpendicular to that portion of the pool wall adjacent to the spray head assembly. At least one water outlet is disposed distally from the inlet duct assembly.

Goggin, U.S. Pat. No. 7,727,387 discloses a swimming pool skimmer pump assembly that operates independently of, but is connected with, a pool filter and pump assembly. The apparatus includes a sealed electrical pump assembly that uses a rotatable magnetic assembly inside the sealed pump body. A magnetic impeller fits within the pump body and rotates in response to rotation of the magnetic assembly inside the sealed pump body. This creates a water flow forcing water out of the bucket assembly in contrast to using a filter pump to suck water through the bucket assembly as in conventional technology. Because each pool skimmer operates independently of others and of the filter pump, they may be located without regard to filter pump efficiencies. Moreover, the suction created is not enough to create a health hazard for users, especially small children.

Norberto, III, US Published Patent Application 2015/0247330, discloses a floating pool skimmer that randomly travels across the surface of a pool to ensure that the entire surface of the water in the pool is cleaned. The floating pool skimmer has an elongated hose that attaches to a conventional fixed pool skimmer, a vacuum inlet and/or a vacuum hose connecting an automatic pool vacuum to a pool pump and filter. A basket held within a main housing strains water and traps debris which is held in the basket by suction from the pool filter while the pool filter is operational. When the pool filter is not running a floating weir and/or one or more weir doors prevents debris from floating back out of the basket and into the pool. Apertures located on the main housing allow water into the main housing that then acts as a ballast to ensure the floating pool skimmer remains upright at all times.

Norberto, III, et al US Published Patent Application 2015/0247331, discloses a floating pool skimmer that randomly travels across the surface of a pool to ensure that the entire surface of the water in the pool is cleaned. The floating pool skimmer has an elongated hose that attaches to a conventional fixed pool skimmer, a vacuum inlet and/or a vacuum hose connecting an automatic pool vacuum to a pool pump and filter. A basket held within a main housing strains water and traps debris which is held in the basket by suction from the pool filter while the pool filter is operational.

Norberto, III, et al US Published Patent Application 2015/0247332, discloses a floating weir basket having a perimeter wall, the perimeter wall has an inner surface, an outer surface, an upper edge surrounding an upper opening and a lower edge surrounding a lower opening. At least one floating weir inlet is located on the perimeter wall of the floating weir proximate to the upper edge of the perimeter wall, and a basket extends downward from the floating weir that strains the water passing through the at least one floating weir inlet to capture debris and prevent debris from passing through the basket.

SUMMARY OF THE INVENTION

The present automated pool skimmer apparatus for removing surface debris overcomes the aforementioned problems and is distinguished over the prior art in general, and these patents in particular. The present pool skimmer apparatus has a generally rectangular housing with an open top end, a bottom wall, opposed first and second end walls, and opposed first and second longitudinal side walls extending upwardly from the bottom wall. Buoyant float members are mounted on the exterior of the end walls and side walls adjacent to their upper ends. A debris-collection net is supported on a support lip on the interior of the housing. A water inlet channel having a bottom end wall and laterally opposed side walls extends outwardly from the upper end of the housing. At least one 12 volt DC submersible pump is mounted in the housing beneath the debris-collection net and receives power from a 120 volt AC to 12 volt DC power converter.

A discharge nozzle assembly connected at one end in fluid communication with a discharge port of the pump or pumps includes a first tubular section that extends horizontally through one side wall of the housing, a first 90° elbow fitting at an outer end of the first tubular section disposed adjacent to the exterior of the side wall that extends outward and downward adjacent to the exterior of the side wall, a second tubular section adjoined to the downward facing leg of the first elbow fitting extending vertically downward therefrom, and a second 90° elbow fitting threadedly and rotatably connected with the lower end of the second tubular section that extends outwardly and downwardly therefrom. A 22½° elbow fitting is connected to the outer end of the second L-fitting.

A manual nozzle adjustment member connected with the second elbow fitting allows a user to rotate and selectively adjust the angular direction of water discharged by the pump to create a circulating current pattern within the pool water that will effectively circulate floating debris therein toward said water inlet channel.

A generally rectangular weir plate is hingedly mounted in the water inlet channel at an outer end thereof and extends between the laterally opposed side walls of the inlet channel. The weir plate has a rectangular slot therethrough, and a float member extending across the upper portion thereof above the slot such that the weir plate assumes a generally upright position due to the float member when the at least one pump is not operating. When the pump is operating, water is drawn into the water inlet channel and the weir plate assumes an angularly inward position toward the interior of the housing due to the flow of water entering the interior of the housing, and in the angular position, a major portion of incoming water passes through the slot and a shallower flow of the incoming water passes over the top of the weir with increased speed and thereby increases tension on the water surface to draw in floating debris faster.

DETAILED DESCRIPTION OF THE INVENTION

Figure 1:
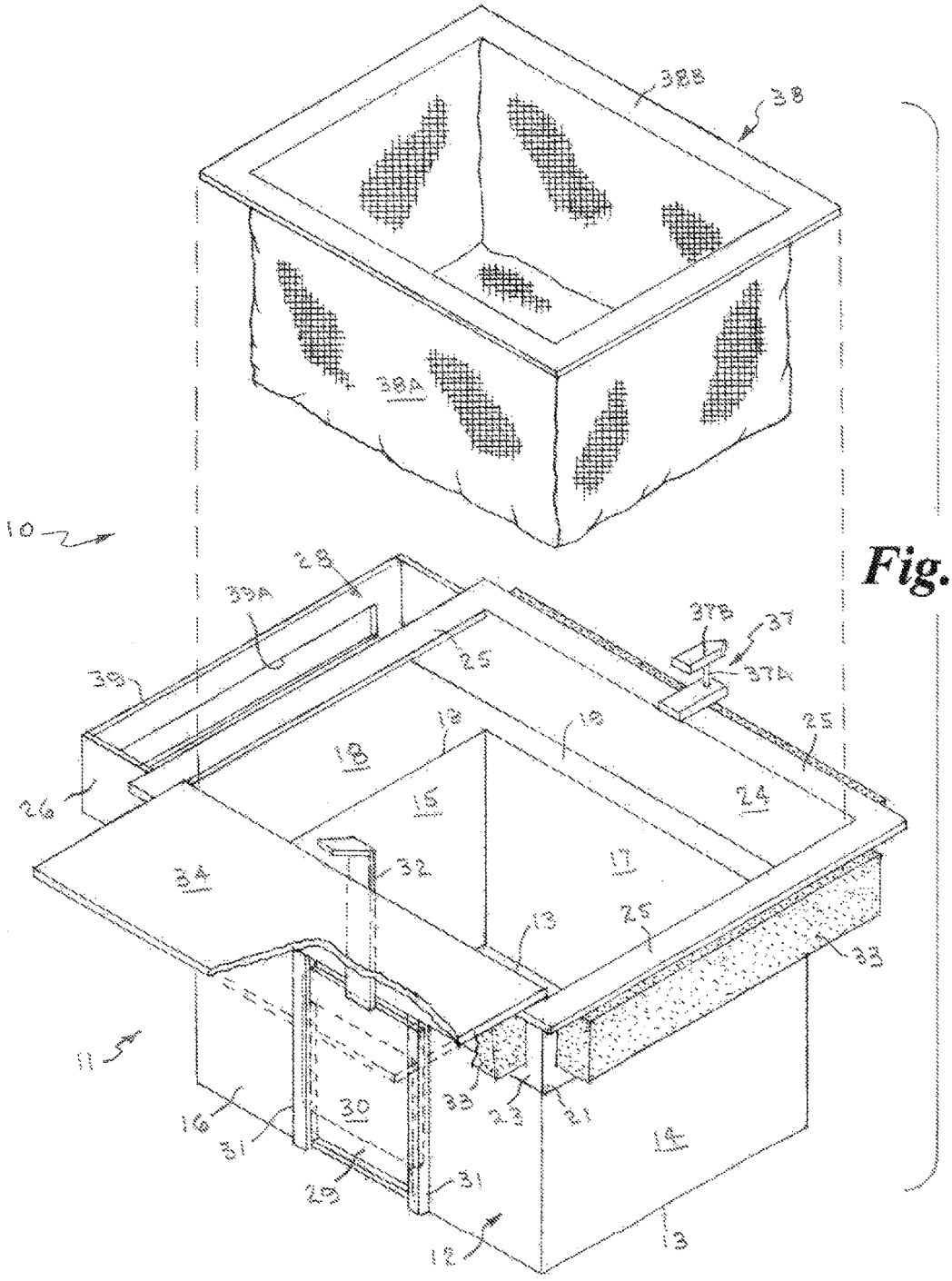
FIG. 1 is a perspective view showing the major components of the pool skimmer apparatus in accordance with the present invention, shown from one side and end with the housing and the debris-collection net components in an unassembled condition.
Figure 2:
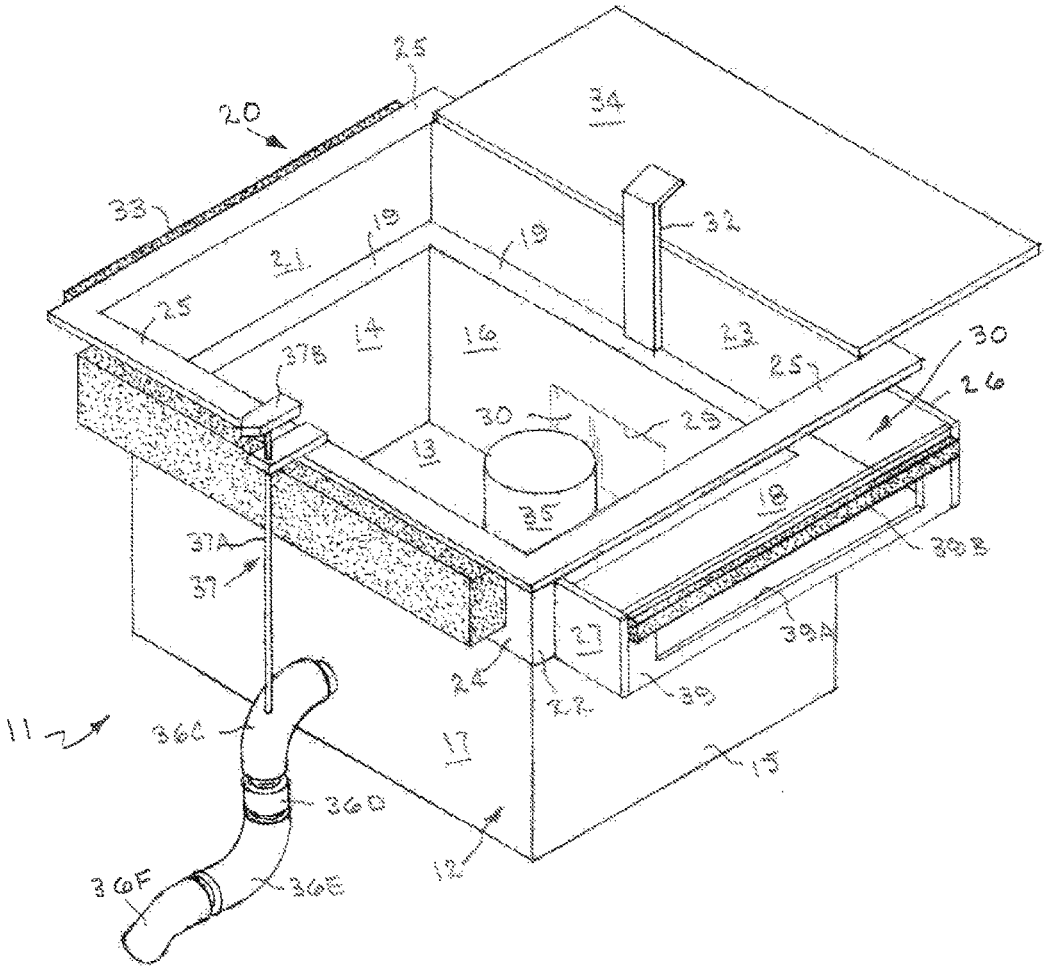
FIG. 2 is a perspective view of the pool skimmer housing, shown from the side and end opposite that shown in FIG. 1.
Figure 3:
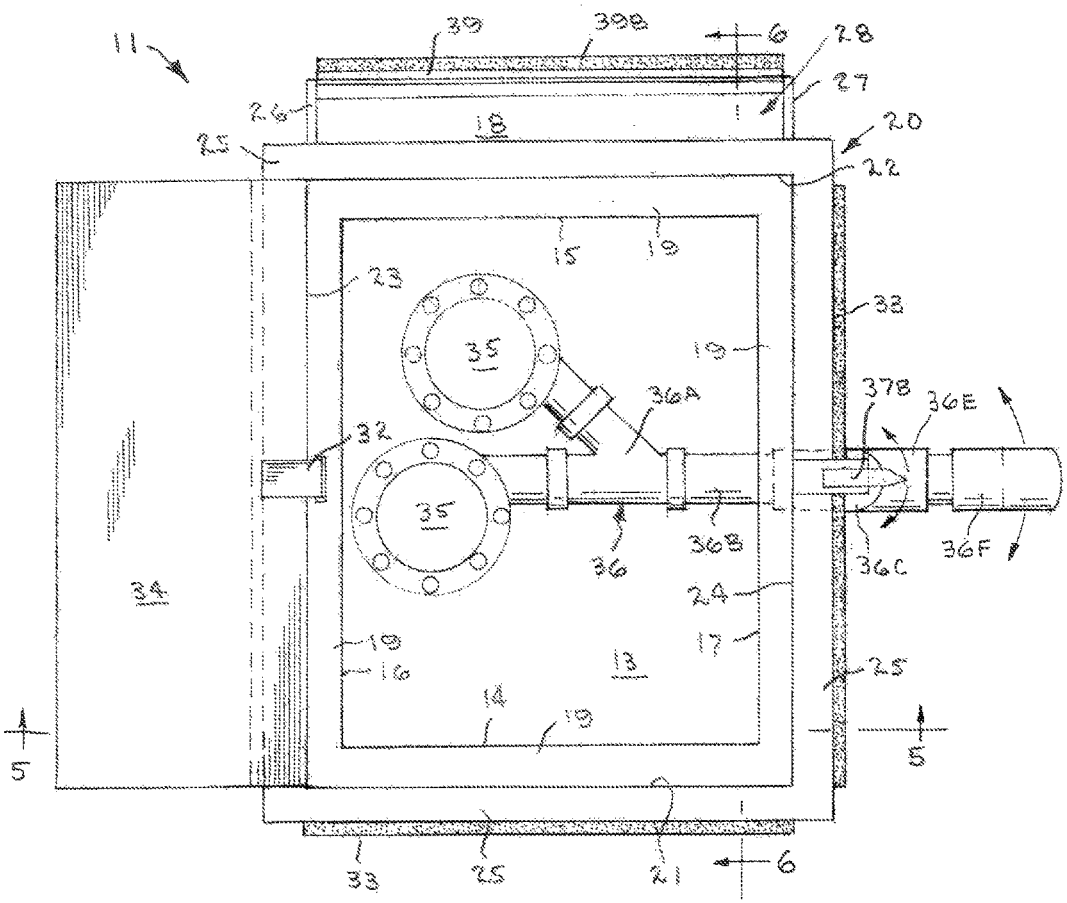
FIG. 3 is a top plan view of the pool skimmer housing, shown with the debris-collection net removed to more clearly show the components that are disposed in the lower portion of the housing.
Figure 4:
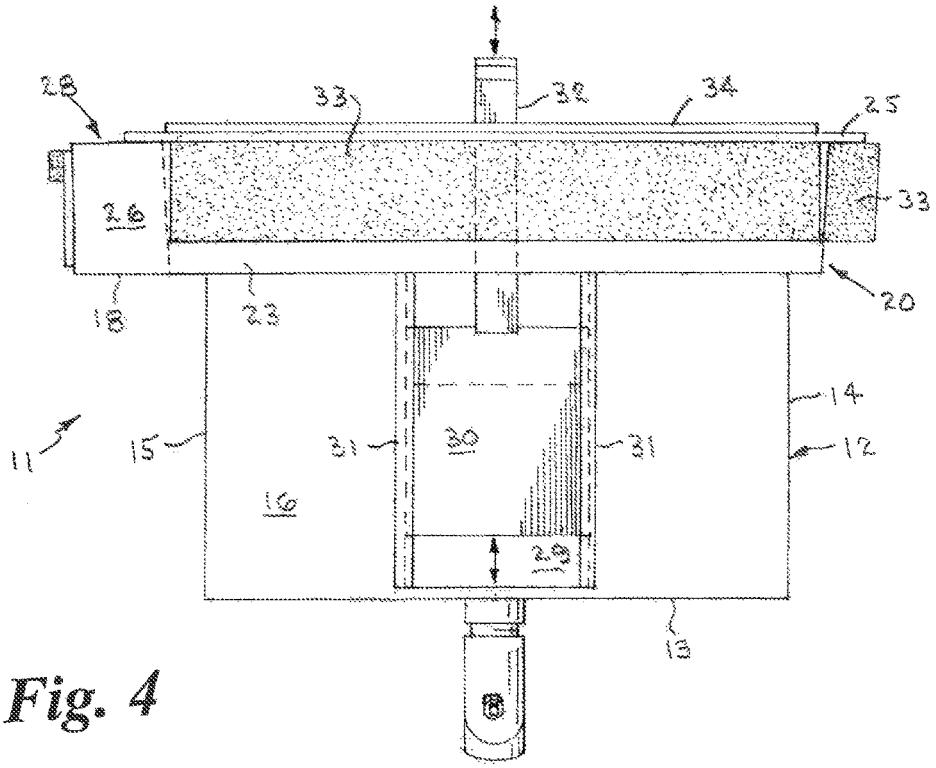
FIG. 4 is a side elevation view of the pool skimmer housing, shown with the sliding plate gate valve in a partially open position.
Figure 5:
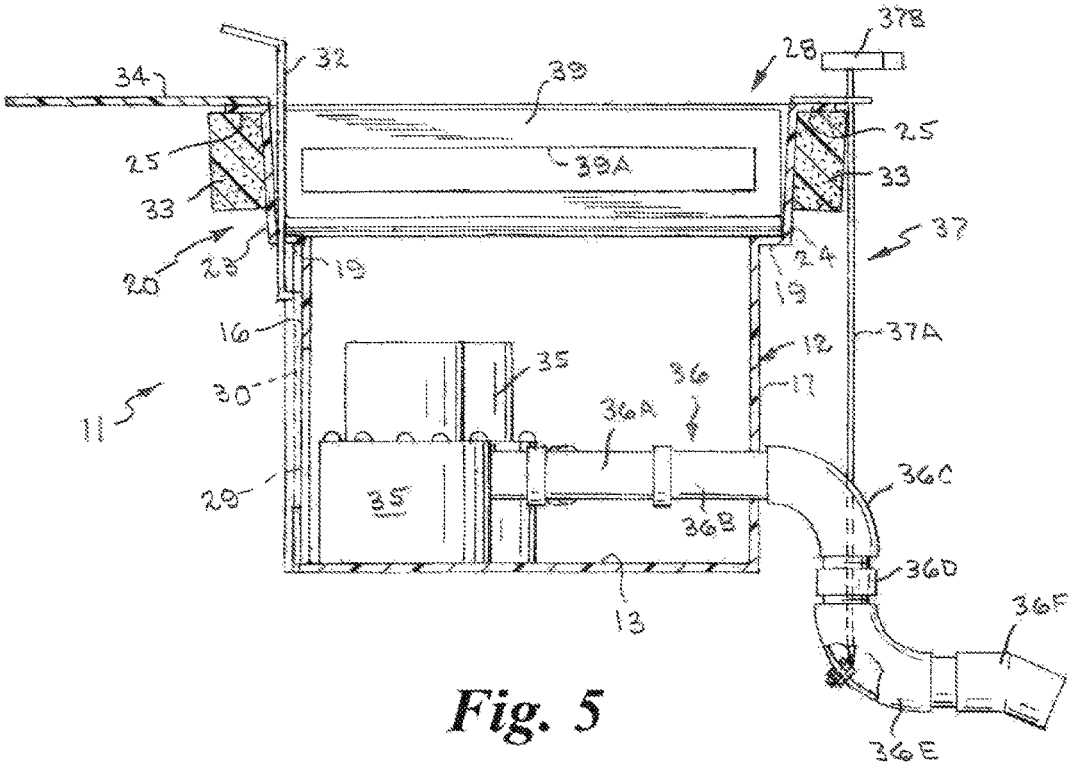
FIG. 5 is a transverse cross section view of the pool skimmer housing, taken along line 5-5 of FIG. 3, with a lower portion of the discharge nozzle assembly cut away to show the connection of the nozzle adjustment member to the lower portion thereof.

Referring now to the drawings by numerals of reference, there is shown in FIG. 1-6, the major components of the pool skimmer apparatus 10 in accordance with a preferred embodiment of the present invention.

The pool skimmer apparatus 10 includes a housing 11 having a lower portion 12 and an upper portion 20. The lower portion 12 is of a generally rectangular configuration having a bottom wall 13, with opposed first and second end walls 14 and 15 and opposed first and second longitudinal side walls 16 and 17 extending vertically upwardly from the bottom wall. The upper ends of the opposed end walls 14 and 15 and longitudinal side walls 16 and 17 of the lower portion terminate in a short outward facing horizontal lip and a horizontal wall 18 extends outwardly a distance from the top end of the end wall 15, defining a four sided interior support flange 19.

The upper portion 20 of the housing 11 is of a generally rectangular configuration having opposed end walls 21 and 22 and opposed longitudinal side walls 23 and 24 adjoined to, and extending upwardly from the interior support flange 19 at the upper end of the end walls 14 and 15 and the opposed longitudinal side walls 16 and 17 of the lower portion 12 of the housing 11. The upper ends of the opposed end walls 21 and 22 and longitudinal side walls 23 and 24 of the lower portion terminate in a short outward facing horizontal lip 25. A pair of laterally opposed side walls 26 and 27 extend a distance outwardly beyond the end wall 21 of the upper portion 20 of the housing, and their bottom ends are adjoined to the horizontal wall 18 that extends outwardly a distance from the upper end of the end wall 15 of the lower portion and together define a water inlet channel 28.

One side wall 16 of the housing 11 lower portion 12 is provided with an opening 29 near its lower end and a sliding plate gate valve member 30 slidably mounted between laterally opposed channels 21 on the side wall that can be manually raised by an elongate upwardly extending tab 32 to expose the opening and allow water in the pool to enter the interior of the housing and facilitate submerging the lower portion of the housing beneath the pool water surface.

A float member 33 formed of buoyant material is mounted on the exterior of the end wall 21 and longitudinal side walls 23 and 24 of the upper portion 20 of the housing 11, respectively near their upper ends. The longitudinal side wall 24 of the upper portion 20, opposite the side of the discharge nozzle (described hereinafter) may be provided with a horizontal bumper plate member 34 that extends a distance outwardly therefrom to maintain the housing a distance outwardly from the side wall of the pool.

In the illustrated example, a pair of 12V DC submersible pumps 35, such as a sump pump or bilge pump are mounted on the bottom wall 13 of the lower portion 12 of the housing 11. In a preferred embodiment, but not limited thereto, the pumps 35 are 12V DC bilge pumps capable of pumping 3,700 GPH each and are powered by a 120 volt to 12 volt power converter, and no battery is required.

A discharge nozzle assembly 36 is connected in fluid communication with the respective pump discharge port by a Y-fitting 36A. The discharge nozzle assembly 36 includes a first tubular section 36B connected to the Y-fitting that extends horizontally through the side wall 17 of the lower portion 12 of the housing 11, a first 90° elbow fitting 36C at an outer end of the first tubular section 36B disposed adjacent to the exterior of the housing side wall that extends outward and downward adjacent to the exterior of the side wall, a second tubular section 36D adjoined to the downward facing leg of the first elbow fitting extending vertically downward therefrom, and a second 90° elbow fitting 36E threadedly and rotatably connected with the lower end of the second tubular section that extends outwardly and downwardly therefrom. A 22½° elbow fitting 36F is connected to the outer end of the second elbow fitting 36E which directs the discharged water angularly downward to prevent the discharged water from disturbing the surface water.

A nozzle adjustment member 37 connected with the discharge nozzle assembly 36 has an elongate vertical rod portion 37A that extends through an aperture in the first elbow fitting 36C and the second elbow fitting 36E and is secured at a bottom end to the second elbow fitting 36E by a nut and lock nut. A hand grip portion 37B is secured to the top end of the vertical rod portion 37A. The threadedly and rotatably connected second elbow fitting 36E of the discharge nozzle assembly can be manually rotated, by a user gripping the hand grip portion 37B and rotating it to selectively adjust the angular direction of the water discharged by the pumps 35 to create a desired circulating current pattern within the pool that will effectively circulate the pool water and any floating debris therein toward the inlet channel 28 of the skimmer.

It should be understood that the Y-fitting 36A of the discharge nozzle assembly 36 may be replaced by a straight tube fitting and a manually adjustable discharge nozzle, as described above, connected to the pump discharge port of each pump. It should also be understood that the skimmer 10 may be provided with a single 12V DC submersible pump capable of pumping at least 7,000 GPH, and the Y-fitting 36A replaced by a straight tube fitting connected to the pump discharge port.

Figure 6:
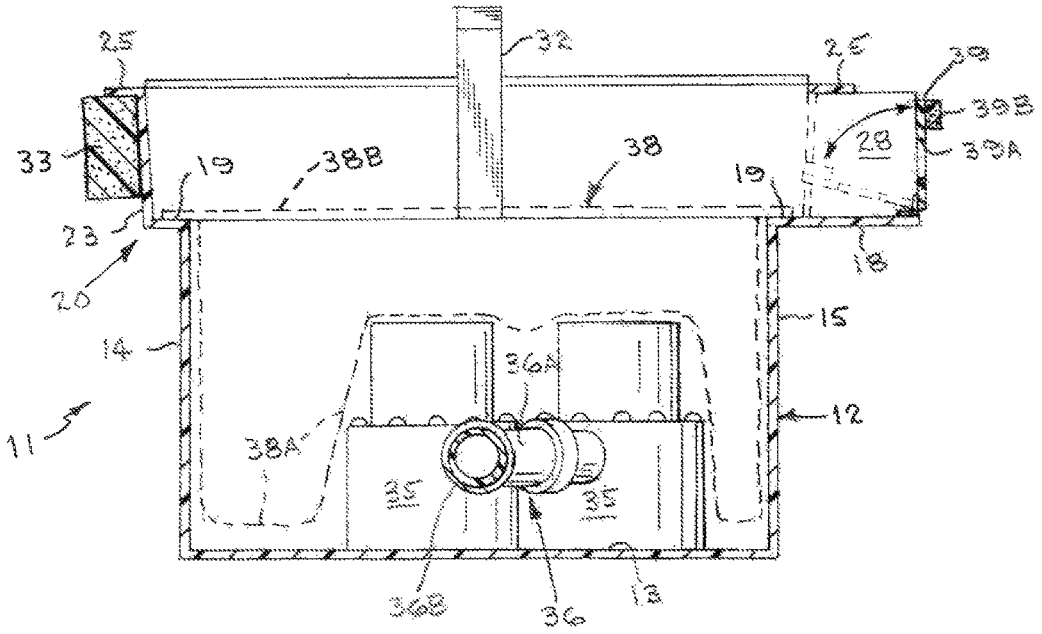
FIG. 6 is longitudinal cross section view of the pool skimmer taken along line 6-6 of FIG. 3, of the pool skimmer apparatus shown with the debris-collection net installed therein in dashed line, and showing the weir an angularly inward position in dashed line.

As seen in FIGS. 1 and 6, a generally rectangular bag-shaped debris-collection net 38 is removably supported in the interior of the housing 11. The debris-collection net 38 has a bag-shaped net portion 38A formed of flexible netting with a four sided flat rectangular peripheral flange 38B surrounding the open mouth of the bag, which is removably supported on the interior support flange 19 at the upper ends of the opposed end walls 14 and 15 and opposed longitudinal side walls 16 and 17 of the lower portion 12 of the main housing 11. The debris-collection net 38 may be provided with conventional handles or lifting means (not shown) for allowing the debris-collection net 38 to be lifted out when the net is full of captured debris. As shown in dashed line in FIG. 6, when the debris-collection net 38 is supported in the interior of the housing 11, the bottom and lower portion of the net portion 38A may drape over the pumps 35 and discharge nozzle assembly 36 components that are disposed in the lower portion 12 of the housing 11.

A generally rectangular inlet weir 39 is mounted in the water inlet channel 28 of the upper portion 20 of the housing 11. The weir 39 is a generally rectangular plate that extends between the outward extending portion of the laterally opposed longitudinal side walls 26 and 27. The bottom edge of the weir 39 is hingedly and pivotally mounted at the outer end of the horizontal wall 18. A rectangular slot 39A is formed through the weir plate, and a thin rectangular float member 39B is secured cross the upper portion of the weir plate above the slot. When the pumps 35 are not operating, the weir 39 assumes a generally upright position due to the float member 37 at the upper end of the weir.

When the pumps 35 are operating, water is drawn into the water inlet channel 28 at the upper portion 20 of the housing 11, and the weir 36 assumes an angularly inward position toward the interior of the housing 11 due to the flow of water entering the interior of the housing, as shown in dashed line in FIG. 6. In the angular position, the majority of the water entering the water inlet channel 28 of the housing will pass through the slot 39A in the weir. This causes a shallower flow of the incoming water to pass over the top of the weir 39 with increased speed and puts more tension on the water surface to draw in floating debris faster. It should be understood that, optionally, the weir 39 may be fixed at an angularly inward position toward the interior of the housing.

OPERATION

The sliding plate gate valve 30 on the lower portion of the skimmer housing is opened to expose the opening 29 and the skimmer housing 11 is partially submerged in the pool closely adjacent to a side of the pool and supported by the float members 33 such that the bottom horizontal wall 18 of the water inlet channel 28 is a short distance beneath the water surface. The skimmer housing may be anchored or otherwise tethered adjacent to the side of the pool so as to remain substantially stationary and prevent excessive tilting and movement due to water discharge during operation. The horizontal bumper plate member 34 at the upper end of the housing 11 maintains the housing a distance outwardly from the side wall of the pool.

In operation, the submersible pumps 35 draw water and floating debris into the water inlet channel 28 of the upper portion 20 of the housing 11, over the inlet weir 39, and into the debris-collection net 38, where the floating debris is collected by the bag portion 38A of the net, and the filtered water is discharged through the discharge nozzle assembly 36 to create a current within the pool that will circulate more of the pool water having floating debris therein into the water inlet channel 28 of the housing 11. Ensuring that the debris in the pool is circulating significantly improves the ability of the present skimmer to capture and remove that debris from the pool because it maximizes the chances that the debris will be drawn into the water inlet channel 28 of the housing 11. The angularly disposed weir 39 causes an increase in speed of the water passing thereover, and tension on the water surface to draw in floating debris faster.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein.

Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. An automated pool skimmer apparatus for removing surface debris from a pool filled with water, comprising:

a generally rectangular housing having an open top end, a bottom wall, opposed first and second end walls, and opposed first and second longitudinal side walls extending upwardly from said bottom wall, a narrow horizontal four sided support flange forming a narrow inward facing support lip on the interior of said housing and defining an upper portion and a lower portion of said housing;

a water inlet channel at an upper end of said first end wall of said housing having a bottom end wall and laterally opposed side walls extending outwardly from said first end wall;

a debris-collection net having a four sided peripheral flange at a top end and a bag portion depending therefrom formed of mesh netting material removably supported on said inward facing support lip;

at least one 12 volt DC submersible pump mounted in said housing at a bottom end thereof beneath said debris-collection net adapted to receive operating power from a 120 volt AC to 12 volt DC power converter;

a discharge nozzle assembly connected in fluid communication with a discharge port of said submersible pump, said discharge nozzle assembly having a tubular portion with an elbow fitting extending outwardly and downward along an exterior of said second longitudinal side wall of said housing, and a second elbow fitting slidably and rotatably connected with a lower end of said first elbow fitting and extending downwardly and outwardly therefrom;

manual nozzle adjustment means connected with said second elbow fitting operable to rotate to selectively adjust the angular direction of water discharged by said pump to create a circulating current pattern within the pool water that will effectively circulate floating debris therein toward said water inlet channel;

float members formed of buoyant material mounted on the exterior of said first end wall and each of said first and second longitudinal side walls, respectively, adjacent to upper ends thereof; and a generally rectangular weir plate hingedly mounted in said water inlet channel at an outer end of said channel bottom wall to extend between said laterally opposed side walls of said inlet channel, a rectangular slot therethrough, and a float member extending across the upper portion thereof above said slot such that said weir plate assumes a generally upright position due to said float member when said at least one pump is not operating; and in operation, when said at least one pump is operating, water is drawn into said water inlet channel and said weir plate assumes an angularly inward position toward the interior of said housing due to the flow of water entering the interior of the housing, and in said angular position, a major portion of incoming water will pass through said slot and cause a shallower flow of the incoming water to pass over the top of the weir with increased speed and increase tension on the water surface to draw in floating debris faster.

2. The automated pool skimmer apparatus according to claim 1, wherein said first longitudinal side wall of said housing has a horizontal bumper plate member extending a distance outwardly therefrom to maintain said housing a distance from a side wall of the pool.

3. The automated pool skimmer apparatus according to claim 1, further comprising:

an opening in said first longitudinal side wall of said housing and a manually movable sliding plate gate valve member slidably mounted on said first longitudinal side wall to selectively expose said opening and allow water in the pool to enter the interior of said housing and facilitate submerging said lower portion of said housing beneath the pool water surface.

4. The automated pool skimmer apparatus according to claim 1, wherein said at least one 12 volt DC submersible pump comprises a pair of 12 volt DC submersible pumps mounted in said housing with their respective discharge ports joined in fluid communication with said discharge nozzle assembly.

5. The automated pool skimmer apparatus according to claim 1, wherein said manual nozzle adjustment means comprises an elongate vertical rod member extending through an aperture in said first L-fitting secured at a bottom end to said second L-fitting, and a hand grip portion at a top end of said rod member.

6. The automated pool skimmer apparatus according to claim 1, wherein said water inlet channel formed of a portion of said opposed first and said longitudinal side walls of said upper portion of said housing that extend a distance outwardly beyond said second end wall of said housing, and said water inlet channel bottom end wall is adjoined to bottom ends of said outwardly extending portion of said opposed first and said longitudinal side walls.

7. The automated pool skimmer apparatus according to claim 1, wherein in operation, said at least one at least one 12 volt DC submersible pump draws water and floating debris into said water inlet channel, over said weir plate, and into said debris-collection net where floating debris is captured by said debris-collection net, and the filtered water is discharged through said discharge nozzle to create a current within the pool that will circulate more of the pool water having floating debris therein into said water inlet channel.

* * * * *